US010247357B2

(12) United States Patent
Navarre, II

(10) Patent No.: US 10,247,357 B2
(45) Date of Patent: Apr. 2, 2019

(54) AUTOMATIC AIR BACKUP SYSTEM

(71) Applicant: C. Wade Navarre, II, Lafayette, LA (US)

(72) Inventor: C. Wade Navarre, II, Lafayette, LA (US)

( * ) Notice: Subject to any disclaimer, the term of this patent is extended or adjusted under 35 U.S.C. 154(b) by 24 days.

(21) Appl. No.: 15/435,103

(22) Filed: Feb. 16, 2017

(65) Prior Publication Data

US 2017/0234485 A1 Aug. 17, 2017

Related U.S. Application Data

(60) Provisional application No. 62/295,964, filed on Feb. 16, 2016.

(51) Int. Cl.
*F17C 1/00* (2006.01)
*A62B 31/00* (2006.01)

(52) U.S. Cl.
CPC ..... *F17C 1/00* (2013.01); *A62B 31/00* (2013.01); *F17C 2221/031* (2013.01); *F17C 2260/044* (2013.01); *F17C 2270/0563* (2013.01)

(58) Field of Classification Search
CPC .... F17C 13/045; F17C 1/00; Y10T 137/2567; Y10T 137/86936; Y10T 137/8175; Y10T 137/87684; Y10T 137/474; E21B 47/011
USPC ..... 222/180, 182, 399
See application file for complete search history.

(56) References Cited

U.S. PATENT DOCUMENTS 2,408,799 A * 10/1946 Melichar ..... F15B 13/02 137/113
2,714,292 A * 8/1955 Strandwitz ..... F17C 13/045 137/113
4,475,665 A * 10/1984 Norton ..... B67D 7/62 222/14
4,739,790 A * 4/1988 Clarke ..... B63C 11/18 128/205.24
4,967,934 A * 11/1990 Andonian ..... F17C 13/04 137/266

* cited by examiner

*Primary Examiner* — Reinaldo Sanchez-Medina
*Assistant Examiner* — Nicole Gardner

(57) ABSTRACT

A system and method for maintaining overpressure in a logging unit or other pressurized space through interruptions is disclosed. A backup air supply comprising tanks mounted to a frame is operatively connected to the ambient environment of the logging unit through a valve assembly which also connects a conventional pressure setup (e.g., pumps and filters from the external environment). The valve assembly comprises two auto valves, a shuttle valve, and a pressure sensor that allow the logging unit to switch from the conventional external air supply to the tanks when the pressure detected from the conventional air supply falls below a predetermined level. The valve assembly is independently housed and may be mounted or detached from the frame housing the backup tanks.

17 Claims, 4 Drawing Sheets

AUTOMATIC AIR BACKUP SYSTEM

STATEMENT OF PRIORITY

This is a non-provisional application claiming priority to U.S. Provisional Application No. 62/295,964, filed on 16 Feb. 2016, and entitled "Automatic Air Backup System." The entirety of the provisional disclosure is incorporated herein by reference.

FIELD OF THE APPLICATION

The present application relates, generally, to a backup system for providing a logging unit or other field environment which is required to be at overpressure with a backup air supply, and a method of automatically switching between the two to avoid interruption.

BACKGROUND

On rigs and other well drilling sites, logging units often contain sensitive electronic equipment which record data from the drilling of a well, equipment which must be protected from contamination from the outside environment. Consequently, these units are often kept at a positive air pressure differential, or overpressure, from the ambient air pressure located outside the logging unit. This air is usually supplied from the ambient atmosphere around the rig itself, utilizing pumps and filters to supply the logging unit with overpressure.

Most logging units respond to interruptions in air supply, whether from mechanical or human error, by preemptively shutting down the logging equipment and only restarting once the unit has again reached overpressure. Since it may take anywhere from 45 minutes to an hour for overpressure to be reestablished, such errors may result in the loss of several thousand feet worth of drilling logs.

A need therefore exists for a backup unit which can supply air at overpressure in the absence of a connection between the outside air supply and the pumps. A need additionally exists for a backup unit which can automatically switch between the two air supplies without the need for a manual intervention.

DRAWINGS

SUMMARY OF THE INVENTION

Figure 1C:
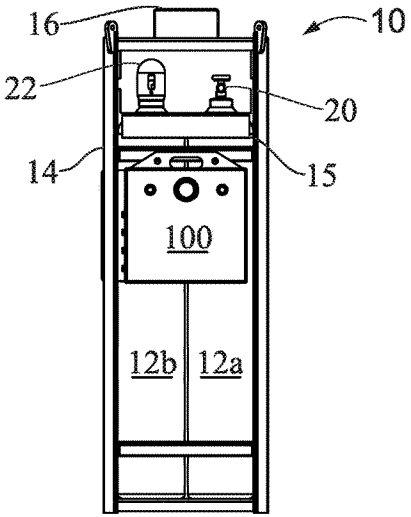
FIG. 1C depicts a front view of an embodiment of the backup unit.
Figure 1B:
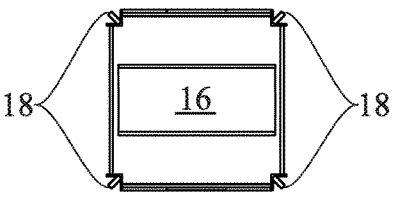
FIG. 1B depicts a top (plan) view of an embodiment of the backup unit.
Figure 1A:
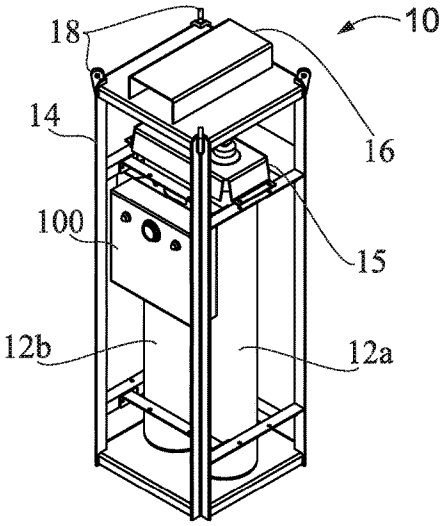
FIG. 1A depicts a perspective view of an embodiment of the backup unit.
Figure 1D:
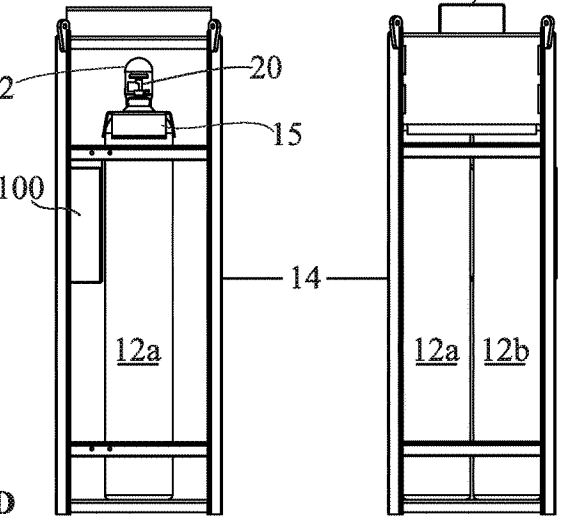
FIG. 1D depicts a side view of an embodiment of the backup unit.
Figure 1E:
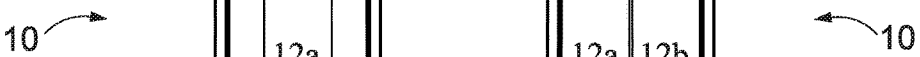
FIG. 1E depicts a rear view of an embodiment of the backup unit.

Embodiments usable within the scope of the present disclosure include a system capable of automatically switching the logging unit environment to a backup air supply system through the use of a valve assembly comprising an external port operatively connected to a standard ambient air supply (e.g., a pump and filter), a backup port operatively connected to a plurality of air tanks mounted in a frame, and an output port operatively connected to both inputs by means of a shuttle valve. Two reset valves control the relative pressures of the standard air supply and the backup air supply; in normal operation, the first reset valve allows the external air supply to circulate through the valve assembly and out the shuttle valve. In the event the external air supply is interrupted, the valves reverse and the first reset valve closes; the second reset valve then opens and allows the backup air tanks to supply air. These pressures may be monitored and controlled by indicator lights, pressure gauges, and regulators.

In an embodiment of a method of use within the scope of the present disclosure, the logging unit is operatively connected to an external pressure source and a backup pressure source. The backup pressure source is kept at a lower pressure than the external pressure source such that when the external pressure source is active, the backup control valve is closed and the external air is allowed through the shuttle valve. When the external pressure source is interrupted or reduced to a pressure less than the backup pressure, the control valves switch and the backup control valve opens while the external control valve closes, allowing backup air to continue being supplied through the shuttle valve.

DETAILED DESCRIPTION OF THE INVENTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Disclosed is an apparatus and method for providing a backup air supply to a logging unit which can automatically switch between external air and stored air. The apparatus can comprise a frame with a plurality of air cylinders for storing the backup air, as well as a front housing/display with an internal valve assembly, status lights, and gauges for measuring the level of overpressure.

Turning first to FIGS. 1A-1E, an embodiment of the backup unit 10 is depicted in perspective, top, front, side, and rear views, respectively. Backup unit 10 comprises a plurality of air tanks 12*a*, 12*b* mounted inside a frame 14. While the depicted embodiment comprises two tanks, it can be appreciated that other embodiments may utilize a single tank or three or more tanks without departing from the scope of this disclosure. In a preferred embodiment, the tanks are pressurized at 17,000 kPa (2500 psi) and regulated down to 550 kPa (80 psi) by an external regulator (not shown).

As shown, frame 14 can comprise a forklift slot 16 and lifting lugs 18 on the top of the frame. The depicted embodiment is roughly 1.78 meters (70 inches) in height and 0.58 meters (23 inches) in width and depth, although it can be appreciated that other embodiments may comprise different dimensions without departing from the scope of this disclosure.

As shown, air tanks 12*a*, 12*b* can be mounted through yoke piece 15 and can comprise at least one manual valve 20, which are optionally enclosed by valve cover 22 (usually in the course of shipping to/from the worksite.) Valve 20 is always open in normal operation and can be regulated at 550 kPa (80 psi) by an external regulator (not shown). The automatic switching capability will be described in greater detail further herein. Tanks 12*a*, 12*b* are operatively connected to a valve assembly 100, which can be located within a detachable housing 101, which may be mounted in frame 14 or stored at a distance from air tanks 12*a*, 12*b*. Once depleted, tanks 12*a*, 12*b* are typically shipped off-site for refilling.

Figure 2C:
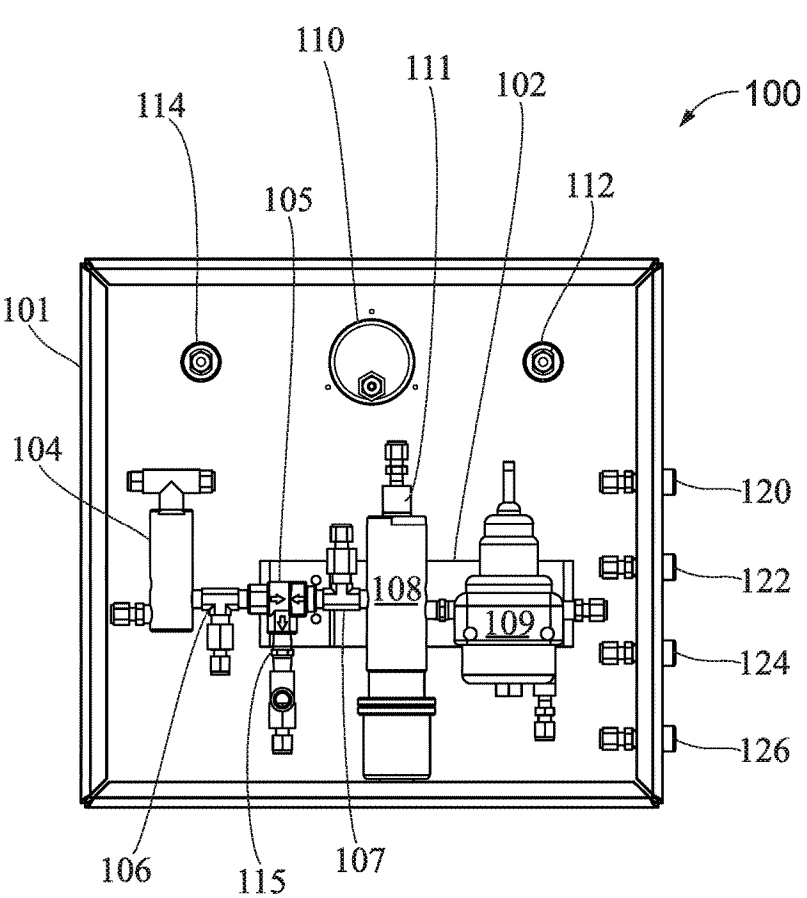
FIG. 2C depicts a cross-sectional view of the valve system within the housing.
Figure 2A:
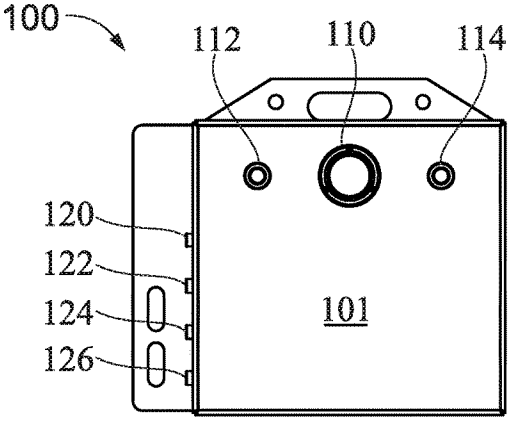
FIG. 2A depicts a front view of the valve system housing.

Turning now to FIG. 2A, an embodiment of the valve assembly 100 is shown in greater detail from the outside, which can include detachable housing 101, pressure gauge 110, indicator lights 112 and 114 indicating airflow coming from ambient air or backup air, respectively, and four side ports (i.e., external air port 120, backup air port 122, output port 124, and drain port 126).

Figure 2B:
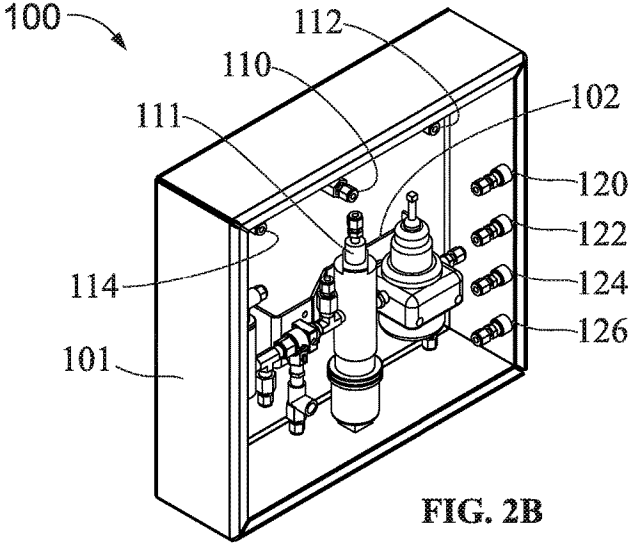
FIG. 2B depicts a perspective view of the valve system within the housing.
Figure 2D:
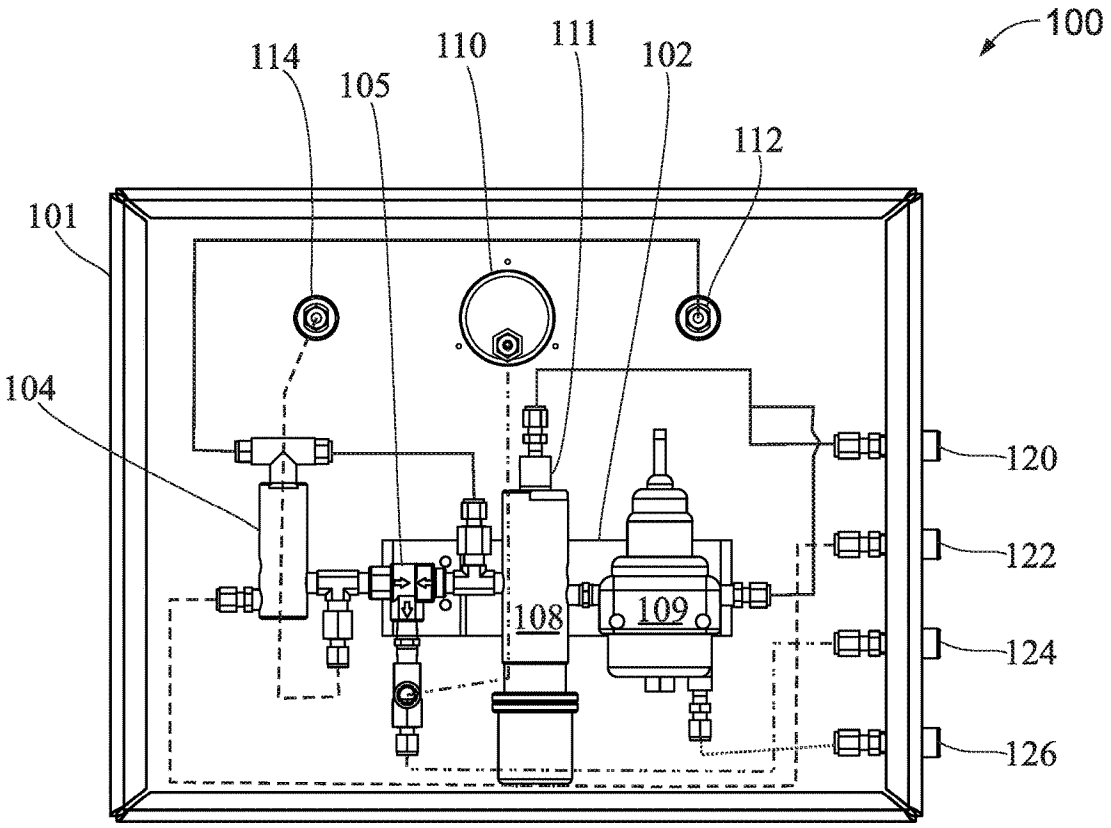
FIG. 2D depicts a flow diagram illustrating connections within the valve system.

Turning now to FIGS. 2B, 2C, and 2D, the internal view of valve assembly 100, with housing 101 open, shows the key components in greater detail. These components include valve mount 102, auto reset valves 104, 108, shuttle valve 105, T-connections 106, 107, and regulator 109 (labeled in FIG. 3A). FIG. 2D is a duplicate drawing of FIG. 2C showing the various flow paths through the valve assembly 100, with some numbering eliminated for clarity. In FIG. 2D, the solid line represents air received from external air port 120, the dashed line represents air received from backup air port 122, the dotted/dashed line represents air being moved into the ambient environment through output port 124, and the dotted line represents fluid drained to drain port 126.

With reference to these figures, the fluid connections are now described in greater detail. Air from the ambient environment can be taken in by regulator 109, through external air port 120, which can feed through a first auto reset valve 108. Auto reset valve 108 may comprise a pressure sensor 111, through which air port 120 can be directly fed into the top side of. This fluid is communicated at a first pressure, which in an embodiment may be 760 kPa (110 psi), but could be greater or lesser without departing from the scope of this disclosure.

Regulator 109 can be looped with auto reset valve 108 and may act to reduce the fluid to a second pressure, which in an embodiment may be 550 kPa (80 psi), but could be greater or lesser without departing from the scope of this disclosure provided the second pressure is less than the first pressure. Condensation from regulator 109 can be drained through drain port 126. After exiting auto reset valve 108, the external air can be fed to T-connection 107, which operatively connects both shuttle valve 105 and the topside of second auto reset valve 104. The top side of second auto reset valve 104 can be further coupled to indicator light 112.

Meanwhile, air from tanks 12*a* and/or 12*b* (not visible in this drawing) can be delivered through backup air port 122, from manual valve 20 (depicted in FIGS. 1A-1E) and through an external regulator (not shown). Backup air port 122 can connect firstly to second auto reset valve 104 and, if the system is shifted to backup air, through T-connection 106, which in turn connects indicator light 114 and shuttle valve 105 from the opposite direction, represented by the arrow pointing left to right, at a third pressure which is less than the first pressure.

Second auto reset valve 104 can be configured to isolate the top side (fluidly coupled to external air port 120 through T-connection 107) and the bottom side (fluidly coupled to backup air port 122 through T-connection 106) from each other during normal operation.

In normal operation, the first pressure will be greater than the second and third pressure, and the system will operate with the first auto reset valve 108 open and the second auto reset valve 104 closed, thus, blocking the air originating from backup air port 122, from going through to T-connection 106 and delivering as output air, sourced from external air port 120, through the regulator 109, first auto reset valve 108, and T-connection 107 (which lights indicator 112). Output is represented by the arrow pointing up to down, which leads to output port 124. Output is also in fluid communication with pressure gauge 110. Output can include reducer 115, which lessens the diameter of the connection as it exits shuttle valve 105 towards output port 124.

However, in the event of interruption of the external air supply to external air port 120, the pressure sensor 111 in the first auto reset valve will detect the interruption, and the auto reset valves 104, 108 will trip and reverse, closing the first reset valve 108 and opening the second auto reset valve 104, allowing air from backup air port 122 to go through the T-connection 106, tripping light indicator 114, and going through to the shuttle valve 105 to output port 124. Reducer 115 ensures this process is not instantaneous by allowing gradual pressure bleed-off from the external air, while shuttle valve 105 and the lessening pressure of the external air supply during bleed-off ensure that there is no backwards flow during this process.

Figure 3B:
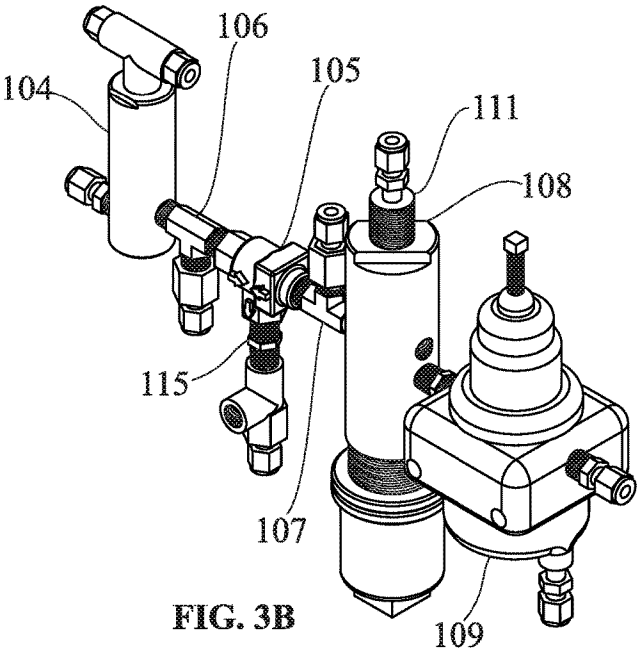
FIG. 3B depicts a perspective view of the valve system in isolation.
Figure 3A:
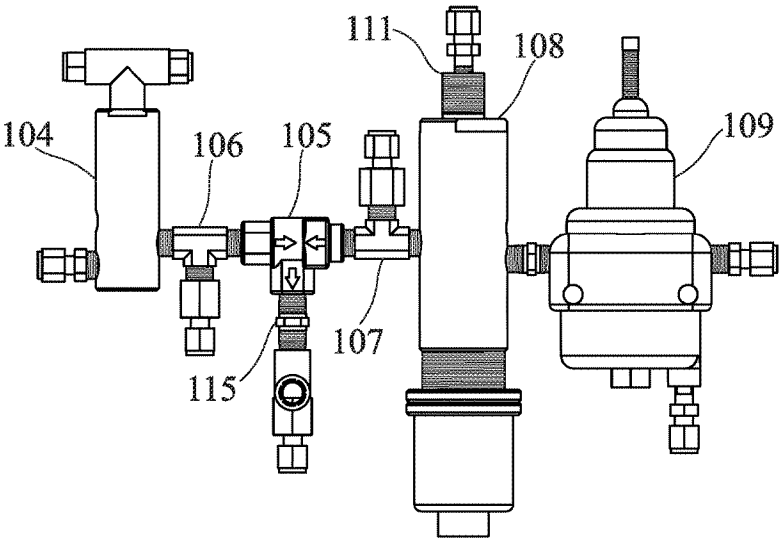
FIG. 3A depicts a side view of the valve system in isolation.

FIGS. 3A-3B depict an embodiment of the invention, with numbered features identical to FIGS. 2B-2C, where the housing is absent and the connections between the valves are shown in greater detail.

Various embodiments, usable within the scope of the present disclosure, have been described with emphasis and these embodiments can be practiced separately or in various combinations thereof. In addition, it should be understood that within the scope of the appended claims, the present invention can be practiced other than as specifically described herein.

The invention claimed is:

1. A system for maintaining overpressure within a logging unit, the system comprising:

a frame;

a plurality of air tanks mounted within the frame;

a valve assembly, the valve assembly comprising:

an external port operatively connected to the atmosphere external to the logging unit through a first reset valve comprising a pressure sensor, the pressure sensor operating to open and close the first reset valve;

a backup port operatively connected to the plurality of air tanks through a second reset valve; and an output port operatively connected to the external port, the backup port, and the ambient atmosphere within the logging unit, wherein the external port and the backup port are operatively connected to the output port through a shuttle valve, wherein the first reset valve is open and the second reset valve is closed while the system receives air from the external port at a selected pressure, and wherein the first reset valve is closed and the second reset valve is open when the system does not receive air from the external port at the selected pressure.

2. The system of claim 1, wherein the valve assembly further comprises a first indicator and a second indicator, wherein the first indicator is in fluid communication with the external port through a first T-junction, and wherein the second indicator is in fluid communication with the backup port through a second T-junction.

3. The system of claim 1, wherein the selected pressure is attained by a regulator operatively connected to the shuttle valve and the external port, wherein the regulator receives air at a first pressure and regulates it to a second pressure less than the first pressure.

4. The system of claim 3, wherein the regulator is operatively connected to a condensation drain port.

5. The system of claim 2, further comprising a pressure gauge operatively connected to a third T-junction in fluid communication with the shuttle valve and the output port.

6. The system of claim 1, wherein the valve assembly is mounted within a detachable housing, and wherein the detachable housing is mounted to the frame.

7. The system of claim 1, wherein the plurality of air tanks are mounted to the frame through a yoke.

8. The system of claim 7, wherein at least one air tank of the plurality of air tanks comprises a manual release valve adjacent to the yoke.

9. The system of claim 1, wherein the frame comprises a plurality of lifting lugs, at least one forklift slot, or combinations thereof.

10. A method for maintaining overpressure within a logging unit, the method comprising:

operatively connecting the internal environment of the logging unit to an external pressure source through a first control valve and a shuttle valve;

operatively connecting the internal environment of the logging unit to a backup pressure source through a second control valve and the shuttle valve;

opening the first control valve and closing the second control valve, thereby allowing the operative connection between the external pressure source and the shuttle valve to achieve a predetermined pressure; and opening the second control valve and closing the first control valve when the operative connection between the external pressure source and the shuttle valve falls below the predetermined pressure.

11. The method of claim 10, wherein the step of opening the second control valve and closing the first control valve is accomplished by means of a pressure sensor located within the first control valve.

12. The method of claim 10, wherein the step of allowing the operative connection between the first external pressure source and the shuttle valve to achieve a predetermined pressure is accomplished by means of a regulator in operative connection with and between the external pressure source and the first control valve.

13. The method of claim 10, wherein the step of allowing the operative connection between the first external pressure source and the shuttle valve to achieve a predetermined pressure further comprises lighting a first indicator.

14. The method of claim 13, wherein the step of opening the second control valve and closing the first control valve further comprises lighting a second indicator.

15. The method of claim 10, wherein the step of operatively connecting the internal environment of the logging unit to a backup pressure source further comprises manually actuating a valve located on the backup pressure source.

16. The method of claim 10, wherein the steps of operatively connecting the internal environment of the logging unit to the external pressure source and the backup pressure source further comprise operatively connecting the shuttle valve to an output port.

17. The method of claim 16, further comprising the step of operatively connecting a pressure gauge with and between the shuttle valve and the output port.

* * * * *